United States Patent [19]

Abe

[11] 4,376,480

[45] Mar. 15, 1983

[54] COIN SORTING DEVICE

[75] Inventor: Hiroshi Abe, Kodaira, Japan

[73] Assignee: Asahi Seiko Co., Ltd., Tokyo, Japan

[21] Appl. No.: 233,583

[22] PCT Filed: May 23, 1980

[86] PCT No.: PCT/JP80/00110

§ 371 Date: Jan. 25, 1981

§ 102(e) Date: Jan. 22, 1981

[87] PCT Pub. No.: WO80/02763

PCT Pub. Date: Dec. 11, 1980

[30] Foreign Application Priority Data

May 25, 1979 [JP] Japan ..... 54-65356
Nov. 10, 1979 [JP] Japan ..... 54-156827

[51] Int. Cl.[3] ..... G07F 3/02
[52] U.S. Cl. ..... 194/101; 194/102
[58] Field of Search ..... 194/100 A, 101, 102, 194/99, 1 D, 1 C, DIG. 15, DIG. 29

[56] References Cited

U.S. PATENT DOCUMENTS 2,339,823 1/1944 Vogel ..... 194/101 X
2,651,399 9/1953 Patzer ..... 194/101
3,601,238 8/1971 Stewart ..... 194/101

FOREIGN PATENT DOCUMENTS 40-14661 5/1965 Japan .
46-3443 1/1971 Japan .
48-61894 6/1973 Japan .
52-97593 7/1977 Japan .

*Primary Examiner*—Stanley H. Tollberg
*Attorney, Agent, or Firm*—Stevens, Davis, Miller & Mosher

[57] ABSTRACT

A coin sorting device comprises a front plate provided with a coin inserting opening, an outside returning lever and a return opening; a stationary side plate fixed to the back surface of the front plate; a movable side plate openably connected at the upper side thereof to and spaced sidewardly from the stationary side plate to define a coin sorting passage; a chute side plate secured to the back surface of the front plate and fixed to and spaced sidewardly from the stationary side plate to define a coin acceptance chute and a return chute therebetween; a cradle pivoted to the movable side plate at an obliquely downward position from the inserting opening so as to receive coins inserted from the inserting opening; an inclined track on the stationary side plate for rolling the coin free of the cradle thereonto; a quality sorting magnet and a keeper opposed to the magnet to create a zone of magnetic flux between the stationary side plate and the movable side plate so as to apply a magnetic braking force to the coin rolling on the inclined track; and a coin deflector suspended displaceably at the branching point for preventing non-acceptable coins from passing into the coin acceptance chute. The device has both the self contained feature of front type coin sorting devices and the superior quality sorting function of drop type coin sorting devices and further inhibits unfair acts which can be considered. Assembling and adjusting operations can be very readily carried out.

4 Claims, 14 Drawing Figures

COIN SORTING DEVICE

TECHNICAL FIELD

The present invention relates to coin sorting devices for use in automatic vending machines, coin operated gaming machines and the like.

BACKGROUND ART

The coin sorting devices of various types for sorting coins, tokens or the like have been well known. In Japanese Utility Model Application laid-open publication No. 52-77,797 there is described a coin sorting device of front type having a front plate provided with a coin inserting opening, an outside returning lever and a return opening, and the front plate is assembled with a stationary side plate, a movable side plate and a chute side plate to define a coin sorting passage, a coin acceptance chute and a return chute by which non-acceptable coins inserted from the coin inserting opening are returned to the return opening in the front plate.

Other typical coin sorting devices are also known such as a drop type coin sorting device having a rocking cradle provided with a pair of engaging lugs or pins spaced from each other in a distance corresponding to the diameter of an acceptable coin for sorting the diameter of the coins and means for sorting the quality of coins magnetically by means of magnetic braking force applied to the coins rolling and passing through a magnetic flux in the coin sorting passage.

The front type coin sorting devices have a self contained construction comprising the coin inserting opening and the return opening and therefor may be assembled in automatic vending machines, coin operated gaming machines and other machines easily and compactly, but have an inferior coin quality sorting function to that of the drop type coin sorting device.

In these days, as the use of automatic vending machines, coin operated gaming machines and the like increases, such unfair acts as the automatic vending machines being actuated by use of non-acceptable coins are cunningly carried out in various ways and result in the coin sorting devices being complicated for satisfying the severe requirement for sorting diameters, thicknesses, metallic contents, weight, centerhole, milling and rim at the outer peripheries of the coins in high precision. Accordingly, the manufacturing, especially assembling and adjusting operations require much labor and expense.

DISCLOSURE OF THE INVENTION

It is the object of the present invention to provide a self contained front type coin sorting device having the same superior quality of sorting function as the drop type coin sorting device to avoid the said drawbacks of the conventional front type coin sorting devices and further inhibit perfectly all of the unfair acts which can be considered and to provide a simple and reliable coin sorting device so arranged that the assembling and adjusting operations can be very readily carried out.

For accomplishing the above mentioned object, the present invention solves various problems and difficulties arising in assembling such parts as the diameter sorting cradle and the magnetic coin quality sorting means of the drop type coin sorting device into the frame of front type coin sorting devices.

One of the above mentioned difficulties is that, owing to location of the cradle at an obliquely downward position from the coin inserting opening, different pushing forces applied to the coins which are inserted in the coin inserting opening by the fingers affect the rocking motion of the cradle to create variations in the motion of the cradle. This results in that non-acceptable coins having smaller diameter than that of acceptable coins but having the same metallic contents as that of acceptable coins take the same travel paths as the acceptable coins to pass through the coin acceptance chute. Other problems are that the non-acceptable coins may be inserted into the coin acceptance chute through the return chute from the return opening, and that it is difficult to open the movable side plate magnetically attracted to the coin quality sorting magnet through a keeper by means of the conventional returning lever because a returning lever having a sufficient lever ratio to open the movable side plate against the magnetic attracting force can not be provided in the view point of the construction of the front type coin sorting device. The present invention solves the above mentioned difficulties and problems in the construction and arrangement of various component parts hereinafter described and particularly pointed out in the appended claims.

According to the invention, the coin sorting device comprises a front plate provided with a coin inserting opening, an outside returning lever and a return opening; a stationary side plate fixed to the back surface of said front plate; a movable side plate openably connected at the upper side thereof to and spaced sidewardly from said stationary side plate to define a coin sorting passage; a chute side plate secured to the back surface of said front plate and fixed to and spaced sidewardly from said stationary side plate to define a coin acceptance chute and a return chute therebetween; a cradle pivoted to said movable side plate at an obliquely downward position from said inserting opening so as to receive coins inserted from said inserting opening; an inclined track on said stationary side plate for rolling the coin free of said cradle thereonto; a coin quality sorting magnet and a keeper opposed to said magnet to create a zone of magnetic flux between said stationary side plate and said movable side plate so as to apply a magnetic braking force to the coin rolling on said inclined track; and a coin deflector suspended displaceably at the branching point for preventing non-acceptable coins from passing into said coin acceptance chute.

BEST MODE OF CARRYING OUT THE INVENTION

Figure 1:
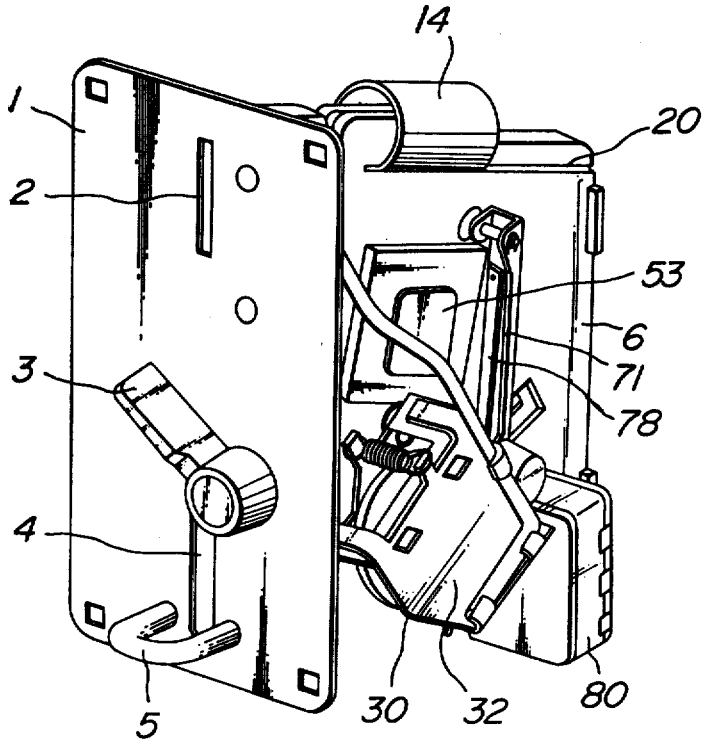
FIG. 1 is a front perspective view of the coin sorting device according to the present invention.
Figure 2:
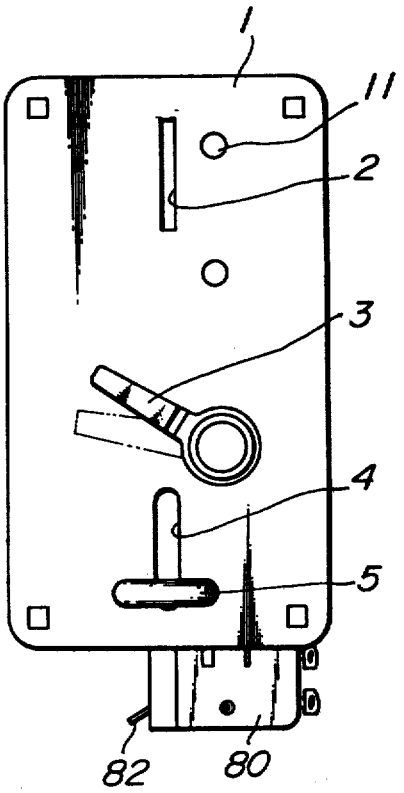
FIG. 2 is a front elevation of the coin sorting device of FIG. 1.

The present invention will be described in reference to the accompanying drawings.

In the drawings, the reference numeral 1 designates a front plate which includes a coin inserting opening 2 having such a size that a non-acceptable coin of a diameter or thickness larger than an acceptable coin can be rejected and further includes an outside returning lever 3, a return opening 4 and a U-shaped return coin receiver 5 for retaining coins discharged from the return opening 4. A stationary side plate 6 is fixed at the front side thereof to the back surface of the front plate 1 and a movable side plate 7 is hingedly connected at the upper side thereof to the upper side of the stationary side plate 6. A chute side plate 8 has integrally a coin acceptance chute side plate portion 9 and a return chute side plate portion 10. The stationary side plate 6, the movable side plate 7 and the chute side plate 8 are each die cast and fitted to each other without use of fasteners such as screws to form a main body of the sorting device in combination with the front plate 1.

Figure 3:
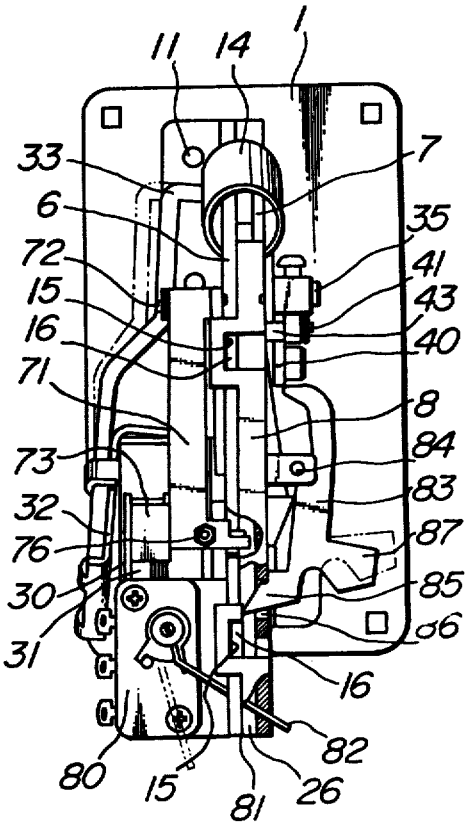
FIG. 3 is a rear elevation of the coin sorting device of FIG. 1.
Figure 4:
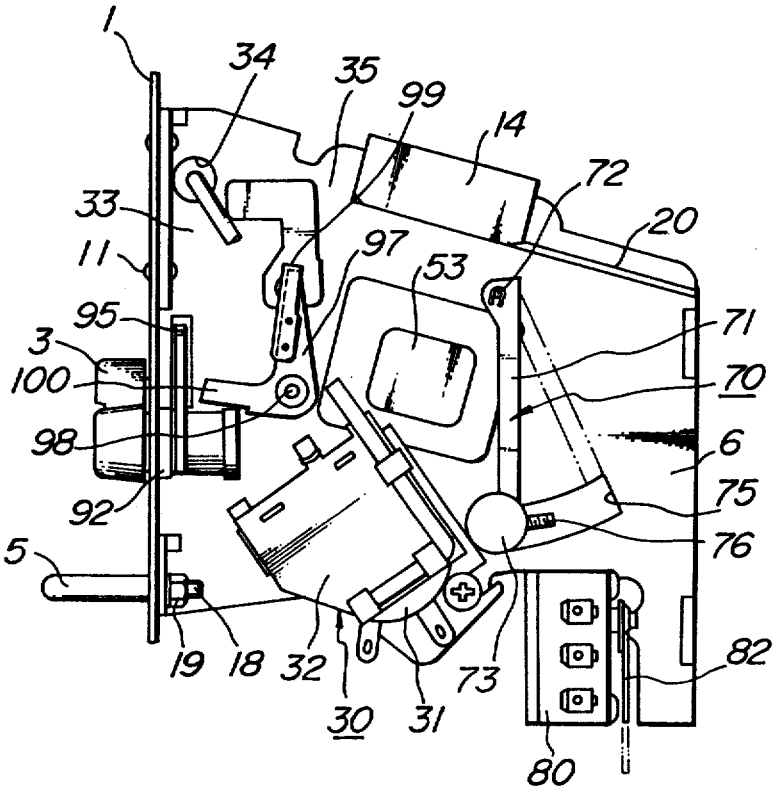
FIG. 4 is a right side elevation of the coin sorting device of FIG. 1.
Figure 5:
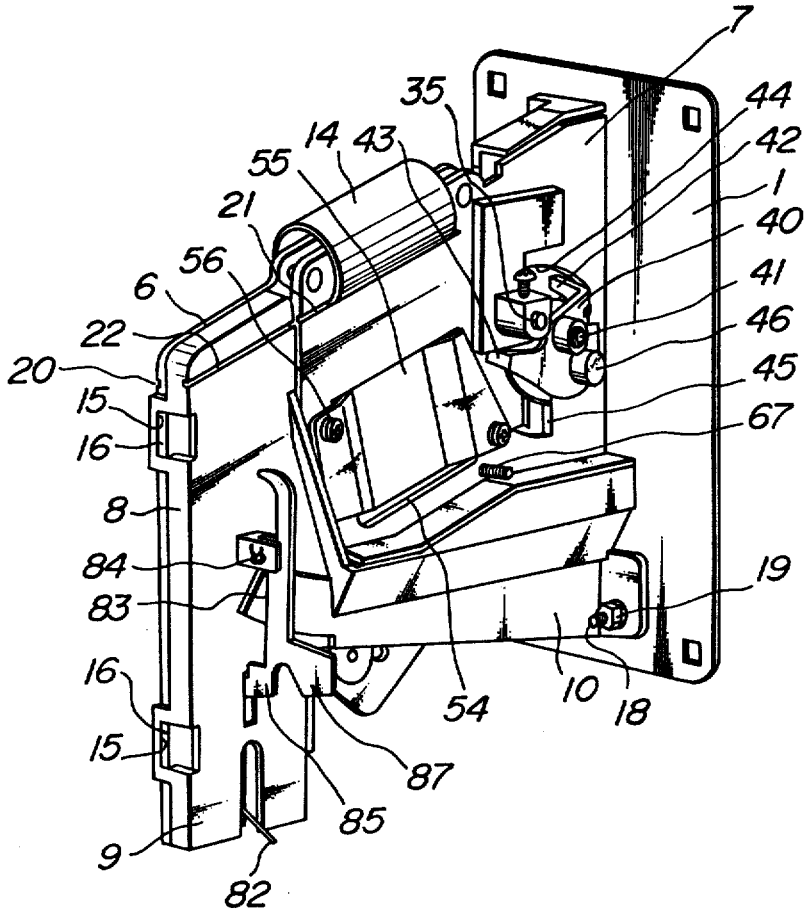
FIG. 5 is a left side perspective view of the coin sorting device of FIG. 1.
Figure 6:
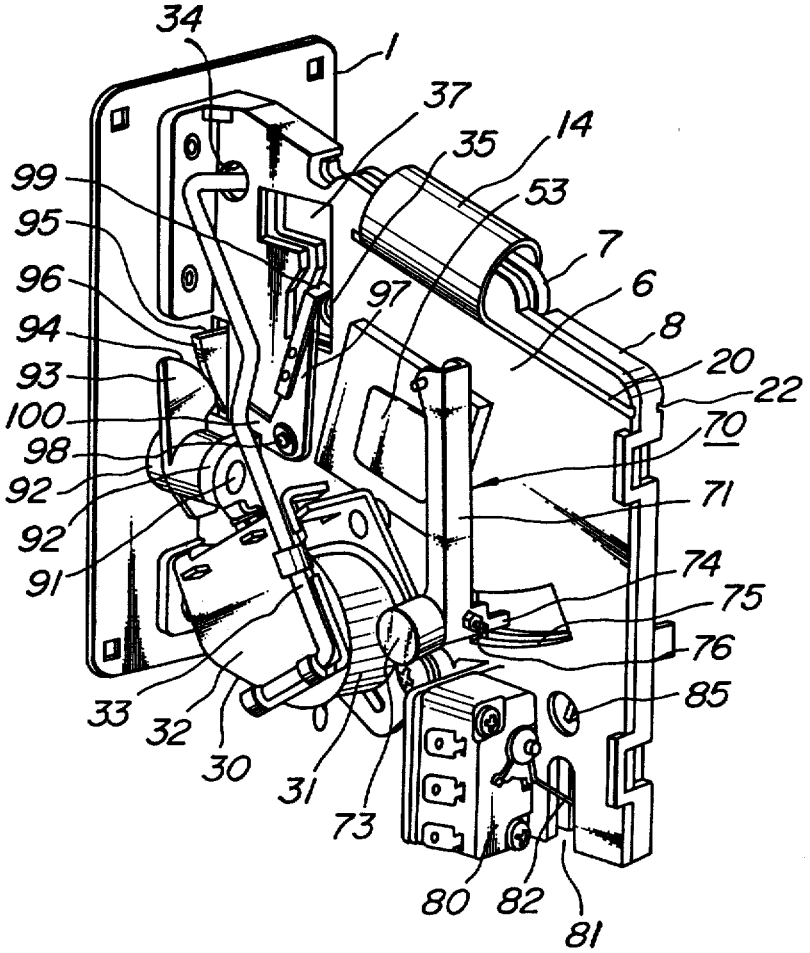
FIG. 6 is a right side perspective view of the coin sorting device of FIG. 1.

The stationary side plate 6 is secured to the back surface of the front plate by means of fastener 11 and the movable side plate 7 is openably connected to the side plate 6 by means of a tubular elastic connector 14. The stationary side plate 6 is provided at the upper edge portion thereof with two spaced projections 13 having semi-spherical tips projected from the inner surface thereof and the movable side plate 7 is provided at the upper edge portion thereof with two receiving cavities 12 formed on the inner surface thereof. The stationary side plate 6 and the movable side plate 7 are assembled in parallel spaced relation to each other with the semi-spherical tips of the projections 13 being inserted into the receiving cavities 12, respectively, and the tubular elastic connector 14 being fitted on the outsides of the upper edge portions of the side plates. The chute side plate 8 is assembled to the stationary side plate 6 with lugs 16 projected from the stationary side plate 6 being fitted into slots 15 (FIGS. 3 and 5) formed in the chute side plate 8. The stationary side plate 6 and the chute side plate 8 may be secured to the front plate 1 by use of threaded portions 18 of the coin receiver 5 extended through the front plate 1 and nuts 19.

The side plates 6, 7 and 8 are provided at the upper edge portions thereof with grooves 20, 21 and 22 formed on the outside surfaces for engaging the edges of a slit in the tubular elastic connector 14. The groove 22 at the upper edge portion of the chute side plate 8 is provided to keep the tubular elastic connector 14 on the main body when the movable side plate 7 is disassembled from the stationary side plate 6. Thus, after the tubular elastic connector is slid onto the groove 22 on the chute side plate from the groove 21 on the movable side plate 7, the movable side plate 7 can be removed from the stationary side plate 6 without removing the elastic connector 13 from the selector body and the movable side plate 7 can be easily reassembled to the stationary side plate 6 only by sliding the elastic connector 13 onto the groove 21 from the groove 22 after the movable plate 7 is positioned.

The stationary side plate 6 and the movable side plate 7 define a coin sorting passage 25 therebetween, the stationary side plate 6 and the coin acceptance chute side plate portion 9 of the chute side plate 8 defines a coin acceptance chute 26 and also the stationary side plate 6 and the return chute side plate portion 10 of the chute side plate 8 defines a return chute 27 communicated with the coin return opening 4.

A blocker 30 is provided for preventing a coin from being inserted through the coin inserting opening 2 when automatic vending machines, coin operated gaming machines and the like are intended not to be used. Said blocker includes an electro-magnet 31, a movable armature 32 and a blocker arm 33 secured to the armature 32. The blocker arm 33 is usually urged into a blocking position by means of a spring so as to extend the free end thereof into the coin sorting passage 25 through a hole 34 in the stationary side plate 6. Thus the blocker arm 33 is drawn out of the passage 25 to permit insertion of coins through the inserting opening when the electromagnet 31 is energized to attract the armature 32 against the spring and thereby the automatic vending machines, coin operated gaming machines and the like are usable.

A magnet piece 35 is secured to the movable side plate for rejecting spurious coins made of ferromagnetic material such as iron.

Figure 7B:
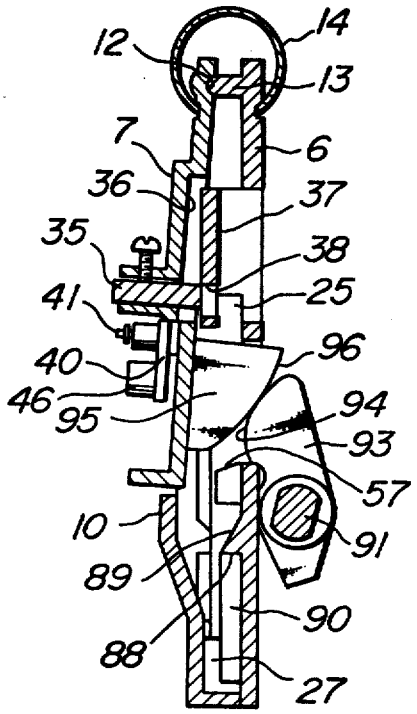
FIGS. 7*a* and 7*b* are longitudinal sectional views for illustrating operation of portions for rejecting steel spurious coin by means of magnetic piece and returning lever.
Figure 7A:
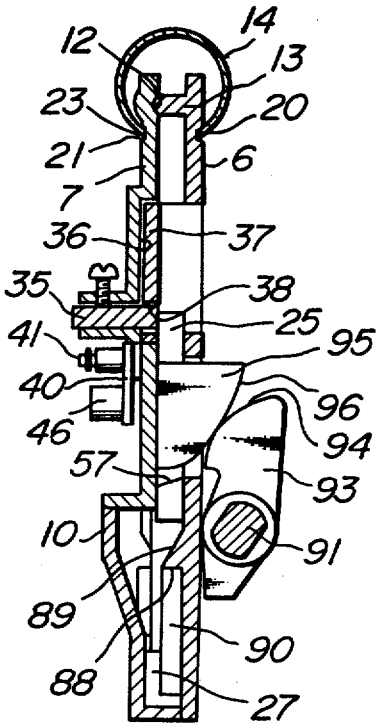

As shown in FIGS. 7*a* and 7*b*, the inner end of the magnet piece 35 is extended to one side of the coin selecting passage 25 through the movable side plate 7 and a removing plate 37 is positioned in the recess 36 so as to attract and reject the non-acceptable coins such as ferromagnetic spurious coins passing the coin sorting passage from the receiving opening 2. In order to remove the spurious coin magnetically attracted to the magnet piece 35, the removing plate 37 is integrally formed with the stationary side plate 6 and is extended to the movable side plate 7 over the coin sorting passage 25 to position in the recess 36 formed in the movable side plate 7. The removing plate 37 is provided with an opening 38 through which the magnet piece 35 is positioned at the one side of the passage 25. Thus, when the returning lever 3 is actuated manually to open the movable side plate 7 as shown in FIG. 7*b*, the magnet piece 35 is retracted out of the opening 38 to release the attracted spurious coin so as to drop it into the return chute 27.

A counter-balanced cradle 40 for sorting the diameters of coins is pivoted at a pin 41 to the movable side plate 7 and is provided with two engaging lugs 42 and 43 which are so spaced to permit non-acceptable coins smaller than the acceptable coins to pass downwardly therebetween into the return chute 27, but to intercept the acceptable coin. The engaging lugs extend into the passage 25 through archshaped openings 44 and 45, respectively, formed in the movable side plate 7. The cradle 40 is usually balanced by means of a balance weight 46 in such a position that the inserted acceptable coin is intercepted by both lugs 42 and 43 and the weight of the coin causes the cradle to rock in a clockwise direction to a position where the coin will roll free of the cradle onto the inclined track 57 in the passage 25.

Figure 8A:
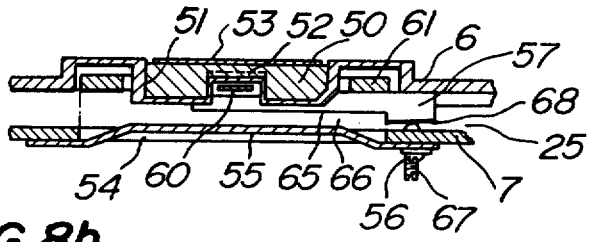
FIGS. 8*a* and 8*b* are transversal sectional views for illustrating operation of the magnetic coin quality sorting means.

A quality sorting magnet 50 is fitted in a recess 51 formed in the stationary side plate 6 and is retained therein by means of a retainer 53 engaged with grooves 52 on the side walls of the recess 51 as shown in FIG. 8*a*. A keeper 55 opposing to the magnet 50 is positioned within an opening 54 formed in the movable side plate 7 and fixed thereto by means of screws 56 so that a magnetic flux crossing the passage 25 is created to provide different magnetic braking force according to the metallic contents of the coins as the coins pass through the magnetic flux while it is rolled on the inclined track 57 in the stationary side plate 6.

Figure 8B:
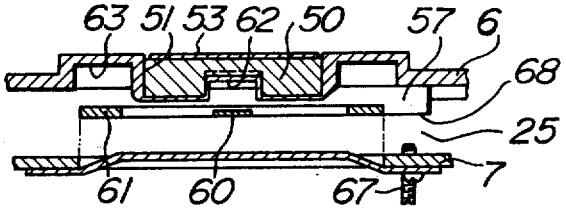

In order to remove therefrom the ferromagnetic spurious coin attracted to the magnet 50, the movable side plate 7 is provided with remover plates 60 and 61 formed integrally therewith. These remover plates are projected from the movable side plate into recesses 62 and 63, respectively formed in the stationary side plate 6 and the recess 51 so that when the movable side plate 7 is opened as shown in FIG. 8*b* by means of the returning lever 3, the remover plates 60 and 61 remove the magnetic spurious coin from the magnet 50 to permit the coin to drop downwardly into the return chute 27.

The inclined track 57 on the stationary side plate 6 has a cut-out portion 65 to define a slit 66 with the inside surface of the movable side plate 7. An adjusting screw 67 is extended into the passage 25 through the side plate 7 and is abutted at the inner end of the screw 67 to the inner surface of the stationary side plate so that the width of the passage 25 and the slit can be adjusted by the screw. The inclined track 57 is inclined in a direction from the inlet to the outlet of the passage downwardly and also inclined towards the movable side plate 7 (as shown in FIGS. 7*a* and 7*b*) so that a non-acceptable coin having a thickness smaller than that of the acceptable coin passes through the slit 66 downwardly into the return chute 27 as the coin rolls on the inclined track 57.

A coin deflector 70 is disposed at the branching point in the coin passage for effecting the separation of acceptable coins from non-acceptable or spurious coins to direct such coins, respectively to the acceptance chute 26 or the return chute 27 depending upon the metallic content thereof. The coin deflector 70 includes a pendulum lever 71 being pivoted at the upper end thereof to a pin 72 on the stationary side plate 6 and having a weight 73 at the lower end so as to be swingably suspended in a perpendicular position. The pendulum lever 71 is provided at the lower end with a deflecting lug 74 which is extended through a slot 75 in the stationary side plate 6 into the passage 25 at the branching point between the acceptance chute 26 and the return chute 27 downstream of the magnet 50. The pendulum lever 71 has an adjusting screw 76 for adjusting the position of the lug 74 by abutting the end of the adjusting screw against a stopper (not shown) on the stationary side plate 6.

The deflecting lug 74 thus provided on the pendulum lever 71 is normally positioned at the branching point by means of the weight 73 so that the lug 74 is displaced towards the acceptance chute 26 to block the entrance for the acceptance chute to prevent the non-acceptable coin from entering into the acceptance chute when the automatic vending machine, the gaming machine or the like is tilted backwardly so as to affect the brake action by the magnet 50 or when the non-acceptable coin is inserted from the return opening 4 through the return chute 27 towards the acceptance chute 26.

A microswitch 80 having a switch actuating arm 82 for detecting the receipt of the acceptable coin is provided for the outlet 81 at the lower end of the coin acceptance chute 26. In order to prevent the actuating arm from actuating by means of a coin suspended by a thread bound thereto, a blocking lever 83 is pivoted at the upper end to the chute side plate 8 by means of a pin 84 so as to project a blocking arm 85 at the lower end thereof through a slot 86 in the chute side plate 8 into the coin acceptance chute 26 at the upward position of the switch actuating arm 82 by means of a weight 87.

Referring to FIGS. 7*a* and 7*b*, the stationary side plate 6 is provided at the under position of the cradle 40 with a stopping wall 88 projected from the inner surface thereof to inhibit insertion of a wire or the like into the under side of the cradle 40 from the return opening 4, but there is an oblique sliding surface 89 at the upper side of the stopping wall to permit the non-acceptable coin passed between the engaging lugs 42 and 43 to drop into the return chute 27 through a side passage at one side of the stopping wall. The stationary side plate 6 is also provided with a stopping wall 90 opposing to the return opening 4 in the front plate 1 to prevent a non-acceptable coin snapped into the return chute from the return opening 4 from passing through the return chute 26 into the coin acceptance chute.

The returning lever 3 is fixed to a lever shaft 91 which is rotatably supported by openings formed in the front plate 1 and a bearing lug 92 projected from the stationary side plate 6. On the shaft 91 is fixed a pusher plate 93 which has a driving face 94 shaped by an involute curve, while the movable side plate is provided at the lower end of the front side thereof with a driven plate 95 projecting sidewardly therefrom towards the pusher plate 93 and having a co-operating driven face 96 shaped by an involute curve so as to cooperate with the driving face 94 so that the turning force applied on the return lever is transmitted to the movable side plate 7 through the point contact between the driving and driven faces 94 and 96 to open the movable side plate 7 underwardly. By shaping the cooperating driving and driven faces 94 and 96 in the shape of involute curves, the opening force applied to the return lever 3 is multiplied so that the movable side plate can be opened very lightly by the return lever in spite of using the sorting magnet having a high magnetic force for obtaining a high performance of quality sorting and further the wear of the cooperating driving and driven faces 94 and 96 resulted by the sliding contact therebetween can be reduced largely. Thus, the opening operation for the movable side plate 7 can be carried out very lightly by the returning lever 3 against the high magnetic attracting force so that it is prevented the movable side plate 7 from displacing to an incorrect position as the result of twisting at the hinge connection portion.

For the purpose of absorbing the energy given by pushing action applied on the coin, an energy absorbing lever 97 is hinged to the stationary side plate 6 by means of a pin 98 so as to extend the upper arm of the lever into the coin sorting passage 25 through an opening formed in the stationary side plate 6 and is normally urged to a predetermined position by means of a counter weight portion 100 so as to engage an engaging thin blade 99 fixed to said upper arm with the milling at the outer periphery of the coin which is inserted through the coin inserting opening 2 at the obliquely upward position of the cradle.

Figure 10A:
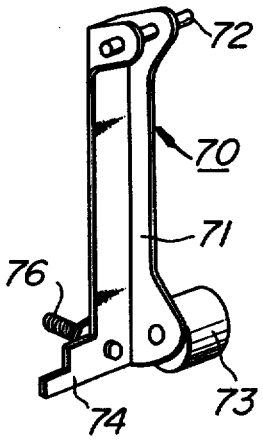
FIGS. 10*a* and 10*b* are perspective views of the pendulum levers.
Figure 10B:
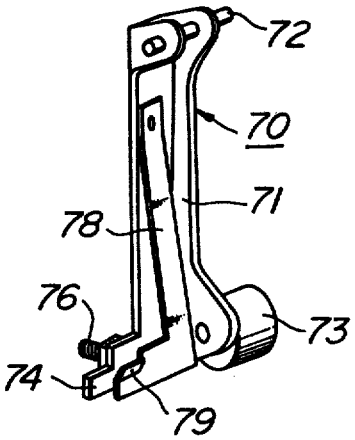
Figure 11:
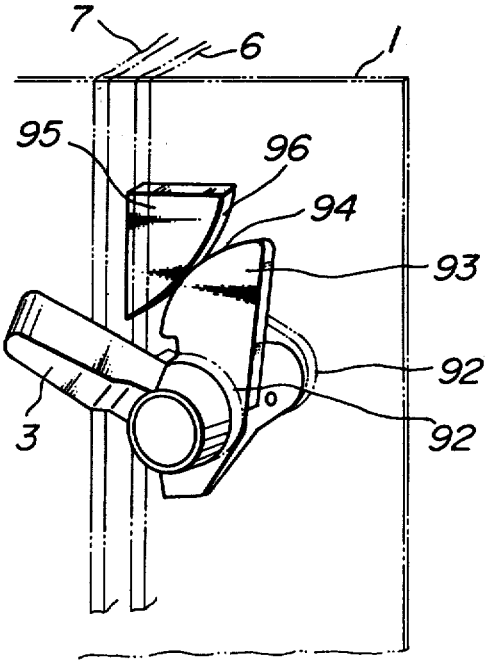
FIG. 11 is a perspective view of the returning lever.

FIG. 10*b* shows an embodiment in which the pendulum lever 71 has a function for checking the milling at the outer periphery of the coin. The pendulum lever 71 is provided with a thin leaf spring 78 having at the lower end thereof a milling checking lug 79 spaced substantially parallel with the deflecting lug 74. The milling checking lug 79 is normally positioned at the branching point between the acceptance chute 26 and the return chute 27 to prevent non-acceptable coins without millings at the outer periphery thereof from passing the acceptance chute.

Figure 9:
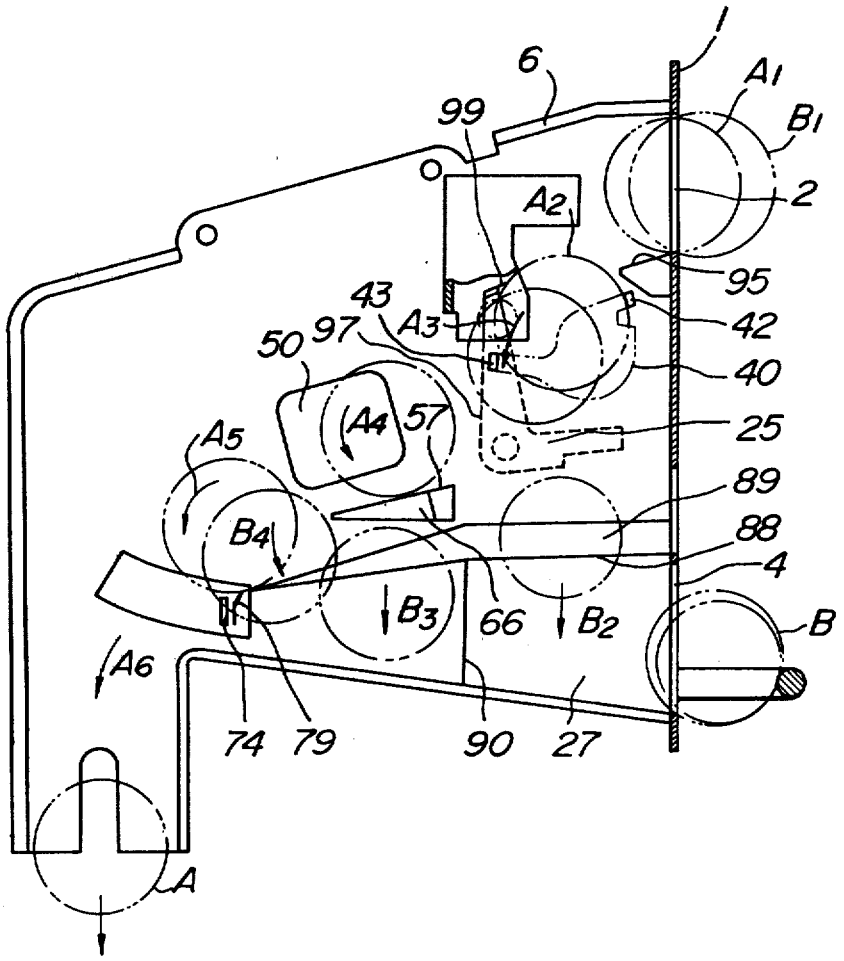
FIG. 9 is a view illustrating the coin travel pass.

FIG. 9 shows the travel of the genuine acceptable coins A and the various non-acceptable coins B. The coins are first sorted for the diameter and the thickness at the coin inserting opening 2 in the front plate 1 to reject the non-acceptable coins $B_1$ having larger diameter and/or thickness than those of the acceptable coins A. Coins $A_1$ inserted into the coin sorting passage 25 are directed toward the cradle 40 as it is guided on the guide 95 in the stationary side plate 6. The coins $A_2$ are engaged by both of the lugs 42 and 43 of the cradle, but the non-acceptable coins $B_2$ having smaller diameter pass the cradle 40 between the lugs 42 and 43 downwardly to drop into the return chute 27. The coins $A_2$ are rotated as shown in $A_3$ by the cradle 40 while the spurious coins made of ferromagnetic material such as iron are magnetically attracted to and arrested by the magnet 35. Then, the coins roll on the inclined track 57 as shown in $A_4$ to pass the coin sorting passage 25 while the slit 66 checks the thickness of the coins to reject the non-acceptable coins thinner than a predetermined thickness into the return chute 27 as shown in $B_3$. As the coins pass through the magnetic flux of the quality sorting magnet 50, their speed of travel is retarded or not depending upon the metallic content of the coins so that the non-acceptable coins push the deflecting lug 74 to a direction for closing the coin acceptance chute 26 and past the return chute 27. While the acceptable coins push the deflecting lug 74 to the opposite direction toward the return chute 27 by the rolling of the coin and pass the acceptance chute 26 as shown in $A_6$ to drop the coin as shown in A into a coin receptacle after actuating the microswitch 80.

When non-acceptable coins having no milling at the outer peripheries thereof but the same dimensions and metallic contents as those of the acceptable coins engage the milling checking lug 79, the plane outer peripheries of the coins push the lug toward the coin acceptance chute 26 to close the entrance for the coin acceptance chute 26 by the deflecting lug 74 so that such coins are also rejected to the return chute 27 as shown in $B_4$.

In the above sorting operation, when non-acceptable coins having smaller diameter than that of the acceptable coins, but milling at the outer peripheries thereof engage the engaging thin blade 99 on the energy absorbing lever 97 as the coins roll in the forward direction on the guide 95, the rolling direction is reversed by the engagement of the milling on the outer periphery thereof and the engaging blade 99. As a result of the reversion of the rolling direction, the smaller coins are affected to deflect the travel thereof underwardly between the lugs 42 and 43 of the cradle 40 to drop into the return chute.

The coin sorting device according to the above arrangement has the following sorting functions and inhibiting functions for various iniquities:

(1) The sorting for coin diameter; The permissible maximum diameter is sorted by the inserting opening 2 and the permissible minimum diameter is sorted by the cradle 40.

(2) The sorting for coin thickness; The permissible maximum thickness is sorted by the inserting opening and the permissible minimum thickness is sorted by the slit 66.

(3) The sorting for metallic contents; This sorting is effected by the magnetically attracting magnet piece 35 and the quality sorting magnet 50;

(4) The sorting for milling at the outer peripheries of coins;

This sorting is effected by the milling checking lug 79 on the pendulum lever 71.

(5) The inhibiting for use in forwardly tilted conditions; This inhibiting is effected by reducing the travel speed of the coins on the inclined track as the result of the forwardly tilted conditions and thereby the coins pass into the return chute.

(6) The inhibiting for use in rearwardly tilted conditions; This is effected by displacing the deflecting lug 74 to close the entrance of the coin acceptance chute 26.

(7) The inhibiting for use in sideward tilted condition; This is effected by reducing the travel speed of the coins owing to the increase of frictional resistance with the side plates to pass the coins into the return chute.

(8) The inhibiting for use with coin suspended by a thread bound thereto; This is effected by providing the blocking lever.

(9) The inhibiting for use of means for closing the returning passage under the cradle; This is effected by providing the stopping wall 88.

(10) The inhibiting for use of non-acceptable coins passing from the returning opening 4 to the coin acceptance chute 26;

This inhibiting is effected by providing the stopping wall 90 and the displaceable deflecting lug 74.

I claim:

1. A coin sorting device comprising:

a front plate provided with a coin inserting opening, an outside returning lever and a return opening;

a stationary side plate fixed to the back surface of said front plate;

a movable side plate openably connected at the upper side thereof to and spaced sidewardly from said stationary side plate to define a coin sorting passage;

a chute side plate secured to the back surface of said front plate and fixed to and spaced sidewardly from said stationary side plate to define a coin acceptance chute and a return chute therebetween;

a cradle pivoted to said movable side plate at an obliquely downward position from said inserting opening so as to receive coins inserted from said inserting opening;

an inclined track on said stationary side plate for rolling the coin free of said cradle thereonto;

a quality sorting means arranged in said stationary side plate and said movable side plate;

means arranged at a branching point from said coin sorting passage to said coin acceptance chute and said return chute for preventing non-acceptable coins from passing into said coin acceptance chute;

an L-shaped energy absorbing lever pivoted at the center thereof to said stationary side plate and having an upper arm extended into said coin sorting passage at the opposite side position of said coin inserting opening for engaging the outer periphery of the coin inserted from said coin inserting opening in the horizontal direction.

2. A coin sorting device comprising:

a front plate provided with a coin inserting opening, an outside returning lever and a return opening;

a stationary side plate fixed to the back surface of said front plate;

a movable side plate openably connected at the upper side thereof to and spaced sidewardly from said stationary side plate to define a coin sorting passage;

a chute side plate secured to the back surface of said front plate and fixed to and spaced sidewardly from said stationary side plate to define a coin acceptance chute and a return chute therebetween;

a cradle pivoted to said movable side plate at an obliquely downward position from said inserting opening so as to receive coins inserted from said inserting opening;

an inclined track on said stationary side plate for rolling the coin free of said cradle thereonto;

a quality sorting means arranged in said stationary side plate and said movable side plate;

means arranged at a branching point from said coin sorting passage to said coin acceptance chute and said return chute for preventing non-acceptable coins from passing into said coin acceptance chute;

said returning lever being provided with a pusher plate fixed to a lever shaft, said pusher plate having a driving face shaped by an involute curve, said movable side plate being provided at the bottom portion in the front side thereof with a driven plate projected therefrom, said driven plate having a driven face shaped by an involute curve co-operating with the driving face of said pusher plate.

3. A coin sorting device comprising:

a front plate provided with a coin inserting opening, an outside returning lever and a return opening;

a stationary side plate fixed to the back surface of said front plate;

a movable side plate openably connected at the upper side thereof to and spaced sidewardly from said stationary side plate to define a coin sorting passage;

a chute side plate secured to the back surface of said front plate and fixed to and spaced sidewardly from said stationary side plate to define a coin acceptance chute and a return chute therebetween;

a cradle pivoted to said movable side plate at an obliquely downward position from said inserting opening so as to receive coins inserted from said inserting opening;

an inclined track on said stationary side plate for rolling the coin free of said cradle thereonto;

a quality sorting means arranged in said stationary side plate and said movable side plate;

means arranged at a branching point from said coin sorting passage to said coin acceptance chute and said return chute for preventing non-acceptable coins from passing into said coin acceptance chute;

said stationary side plate being provided at an under position of said cradle with a stopping wall projected from the inner surface of the stationary side plate for inhibiting insertion of a wire from said return opening and at the upper side of the stopping wall with an oblique sliding surface for permitting a coin to drop into the return chute.

4. A coin sorting device comprising:

a front plate provided with a coin inserting opening, an outside returning lever and a return opening;

a stationary side plate fixed to the back surface of said front plate;

a movable side plate openably connected at the upper side thereof to and spaced sidewardly from said stationary side plate to define a coin sorting passage;

a chute side plate secured to the back surface of said front plate and fixed to and spaced sidewardly from said stationary side plate to define a coin acceptance chute and a return chute therebetween;

a cradle pivoted to said movable side plate at an obliquely downward position from said inserting opening so as to receive coins inserted from said inserting opening;

an inclined track on said stationary side plate for rolling the coin free of said cradle thereonto;

a quality sorting means arranged in said stationary side plate and said movable side plate;

means arranged at a branching point from said coin sorting passage to said coin acceptance chute and said return chute for preventing non-acceptable coins from passing into said coin acceptance chute;

said stationary side plate being provided at a position opposed to said return opening with a stopping wall extended into said return chute for inhibiting insertion of coins from said return opening to said coin acceptance chute.

* * * * *